US010273128B2

(12) United States Patent
Kosuga

(10) Patent No.: US 10,273,128 B2
(45) Date of Patent: Apr. 30, 2019

(54) ROPE HOIST

(71) Applicant: KITO CORPORATION, Nakakoma-gun, Yamanashi (JP)

(72) Inventor: Kosuke Kosuga, Yamanashi (JP)

(73) Assignee: KITO CORPORATION, Yamanashi (JP)

( * ) Notice: Subject to any disclaimer, the term of this patent is extended or adjusted under 35 U.S.C. 154(b) by 181 days.

(21) Appl. No.: 15/316,664

(22) PCT Filed: May 22, 2015

(86) PCT No.: PCT/JP2015/064820

§ 371 (c)(1),
(2) Date: Dec. 6, 2016

(87) PCT Pub. No.: WO2015/186541

PCT Pub. Date: Dec. 10, 2015

(65) Prior Publication Data

US 2017/0158472 A1 Jun. 8, 2017

(30) Foreign Application Priority Data

Jun. 6, 2014 (JP) ..... 2014-117949

(51) Int. Cl.
*B66D 3/24* (2006.01)
*B66D 3/22* (2006.01)
(Continued)

(52) U.S. Cl.
CPC ..... *B66D 3/24* (2013.01); *B66D 1/38* (2013.01); *B66D 3/22* (2013.01); *B66D 3/26* (2013.01); *B66D 2700/025* (2013.01)

(58) Field of Classification Search
CPC ... B66D 3/22; B66D 3/24; B66D 3/26; B66D 1/38; B66D 2700/025
See application file for complete search history.

(56) References Cited

U.S. PATENT DOCUMENTS 301,863 A * 7/1884 Cheney ..... B66D 3/24 254/276
342,038 A * 5/1886 Pugh ..... B66D 3/24 254/276

(Continued)

FOREIGN PATENT DOCUMENTS

CN 103228570 A 7/2013
CN 104395225 A 3/2015

(Continued)

OTHER PUBLICATIONS

International Search Report corresponding to Application No. PCT/JP2015/064820; dated Jul. 28, 2015, with English translation.

(Continued)

*Primary Examiner* — Michael E Gallion
(74) *Attorney, Agent, or Firm* — Cantor Colburn LLP

(57) ABSTRACT

A rope hoist includes: a rope drum around which a wire rope W is wound; a support shaft and a limit switch bolt arranged to be parallel to the rope drum; limit switch mechanisms; and a rope guide mechanism moving in accordance with a winding state of the wire rope W, and making the limit switch mechanisms perform on/off operation. Each of the limit switch mechanisms includes: a limit switch metal fitting into which both of the support shaft and the limit switch bolt are inserted, in which the limit switch metal fitting is sandwiched and fixed by nuts from both sides thereof in an axial direction of the limit switch bolt.

8 Claims, 9 Drawing Sheets

(51) Int. Cl.
*B66D 3/26* (2006.01)
*B66D 1/38* (2006.01)

(56) References Cited

U.S. PATENT DOCUMENTS

| | | | | | |
|---|---|---|---|---|---|
| 2,303,847 | A * | 12/1942 | Lamond | B66D 1/48 | 254/273 |
| 3,519,246 | A * | 7/1970 | Hartley | B66D 3/02 | 187/250 |
| 6,135,421 | A * | 10/2000 | Bartelme | B66D 1/56 | 254/268 |
| 6,182,592 | B1 * | 2/2001 | Molz | B63B 21/16 | 114/230.2 |
| 6,811,112 | B1 * | 11/2004 | Currie | B65H 54/2872 | 242/157.1 |
| 8,657,261 | B2 * | 2/2014 | Mehrkens | A63C 11/10 | 254/323 |
| 9,048,698 | B2 | 6/2015 | Hiroshima | | |
| 9,248,999 | B2 * | 2/2016 | Xydias | B66D 1/38 | |
| 9,802,799 | B2 | 10/2017 | Ishikawa et al. | | |
| 9,988,248 | B2 * | 6/2018 | Hall | B66D 1/14 | |
| 2013/0221809 | A1 * | 8/2013 | Hiroshima | B66D 3/20 | 310/60 R |
| 2015/0166312 | A1 | 6/2015 | Ishikawa et al. | | |
| 2015/0191335 | A1 | 7/2015 | Ishikawa et al. | | |
| 2017/0107084 | A1 * | 4/2017 | Yudate | B66C 11/16 | |
| 2018/0162702 | A1 * | 6/2018 | O'Connor | B66D 3/22 | |

FOREIGN PATENT DOCUMENTS

| | | | |
|---|---|---|---|
| CN | 104428238 | A | 3/2015 |
| DE | 1034340 | B | 7/1958 |
| JP | 3316738 | Y1 | 10/1958 |
| JP | 53066773 | U | 6/1978 |
| JP | 58001079 | Y | 1/1983 |
| JP | 62038279 | B2 | 8/1987 |
| JP | 2569647 | Y2 | 4/1998 |
| JP | 4646679 | B | 12/2010 |
| JP | 5029188 | B2 | 9/2012 |
| JP | 5149615 | B | 12/2012 |
| JP | 5149615 | B2 | 2/2013 |
| JP | 2014070676 | A | 4/2014 |

OTHER PUBLICATIONS

SIPO First Office Action for corresponding CN Application No. 201580029931.7; dated Feb. 23, 2018.
Notice of Reasons for Rejection corresponding to Japanese Application No. 2014-117949; dated Feb. 28 2017, with English abstract.

* cited by examiner

ROPE HOIST

TECHNICAL FIELD

The present invention relates to a rope hoist which is used when performing operation of discharging of cargo, when moving a cargo in a horizontal direction or a vertical direction, and the like.

BACKGROUND ART

In order to move a cargo in a longitudinal direction and to move the suspended cargo along a rail installed on a ceiling side, a rope hoist is generally used. There is a rope hoist which includes a limit switch regulating a wind-up position and an unwind position of a wire rope. For example, in a configuration of a limit switch disclosed in PTL 1, a limit switch is attached to an outside of a motor, and a limit guide fixed to a rope guide is provided.

CITATION LIST

Patent Literature

{PTL 1} Japanese Examined Patent Application Publication No. S62-38279

SUMMARY OF INVENTION

Technical Problem

In the rope hoist disclosed in PTL 1, the rope guide moves in a horizontal direction in accordance with the wind-up of the rope, so that the limit guide also moves in the horizontal direction. By the movement, the limit guide presses a limit switch stopper fixed to a limit rod. The pressed limit switch stopper presses a limit switch. The structure as above has a problem that it is not possible to accurately detect the position of the rope guide due to reasons such that the limit guide is easily deformed, the limit rod is a movable body which moves horizontally, and so on. Further, since the limit rod is the movable body which moves horizontally, it is difficult to perform fine adjustment of the position of the limit switch stopper. Further, since the limit switch is attached, in an exposed manner, to the outside of the motor, there is a possibility that an object from the outside hits against the limit switch, which may damage the limit switch.

The present invention is made based on such problems, and an object of the present invention is to provide a rope hoist capable of accurately detecting a position of a moving object such as a rope guide, and capable of performing fine adjustment of the detection position. Further, another object of the present invention is to provide a rope hoist capable of preventing damage of a limit switch caused when an object from the outside hits against the limit switch.

Solution to Problem

In order to solve the above-described problems, a rope hoist of the present invention provided with: a rope drum around which a wire rope can be wound; end frame members respectively arranged at both ends of the rope drum, the rope drum being rotatably supported by the end frame members; a support shaft bridged between both of the end frame members, and arranged to be parallel to the rope drum; limit switch mechanisms arranged at a predetermined wind-up position and a predetermined unwind position, respectively, of the wire rope, the limit switch mechanisms having a limit switch metal fitting; and a moving member moving in accordance with a winding state of the wire rope, and making the limit switch mechanisms perform on/off operation, the rope hoist includes: a limit switch fixing bar arranged to be parallel to the support shaft and the rope drum; and a limit switch metal fitting into which both of the support shaft and the limit switch fixing bar are inserted, in which the limit switch metal fitting is fixed by a fixing means in a manner that a position of the limit switch metal fitting in an axial direction of the limit switch fixing bar can be adjusted.

Further, in addition to the above-described invention, it is preferable that the limit switch fixing bar corresponds to a limit switch bolt, the fixing means corresponds to nuts screwed with the limit switch bolt, and the limit switch metal fitting is sandwiched and fixed by the nuts from both sides thereof in an axial direction of the limit switch bolt.

Further, in addition to the above-described invention, it is preferable that a moving member support shaft is bridged between both of the end frame members and arranged to be parallel to the rope drum regulates a rotation of the moving member.

Further, in addition to the above-described invention, it is preferable that the limit switch fixing bar is supported by a cantilever support structure in which one end thereof is supported by the end frame member, and the other end thereof is not supported.

Further, in addition to the above-described invention, it is preferable that two of the limit switch mechanisms are arranged, and each of the limit switch mechanisms includes a limit switch main body part provided with a switch mechanism, and a detector, in which the limit switch mechanism arranged at the wind-up position of the wire rope is attached so that a tip portion of the detector is directed to a direction in which the wire rope is wound-up, and the limit switch mechanism arranged at the unwind position of the wire rope is attached so that a tip portion of the detector is directed to a direction in which the wire rope is unwound.

DESCRIPTION OF EMBODIMENTS

Figure 1:
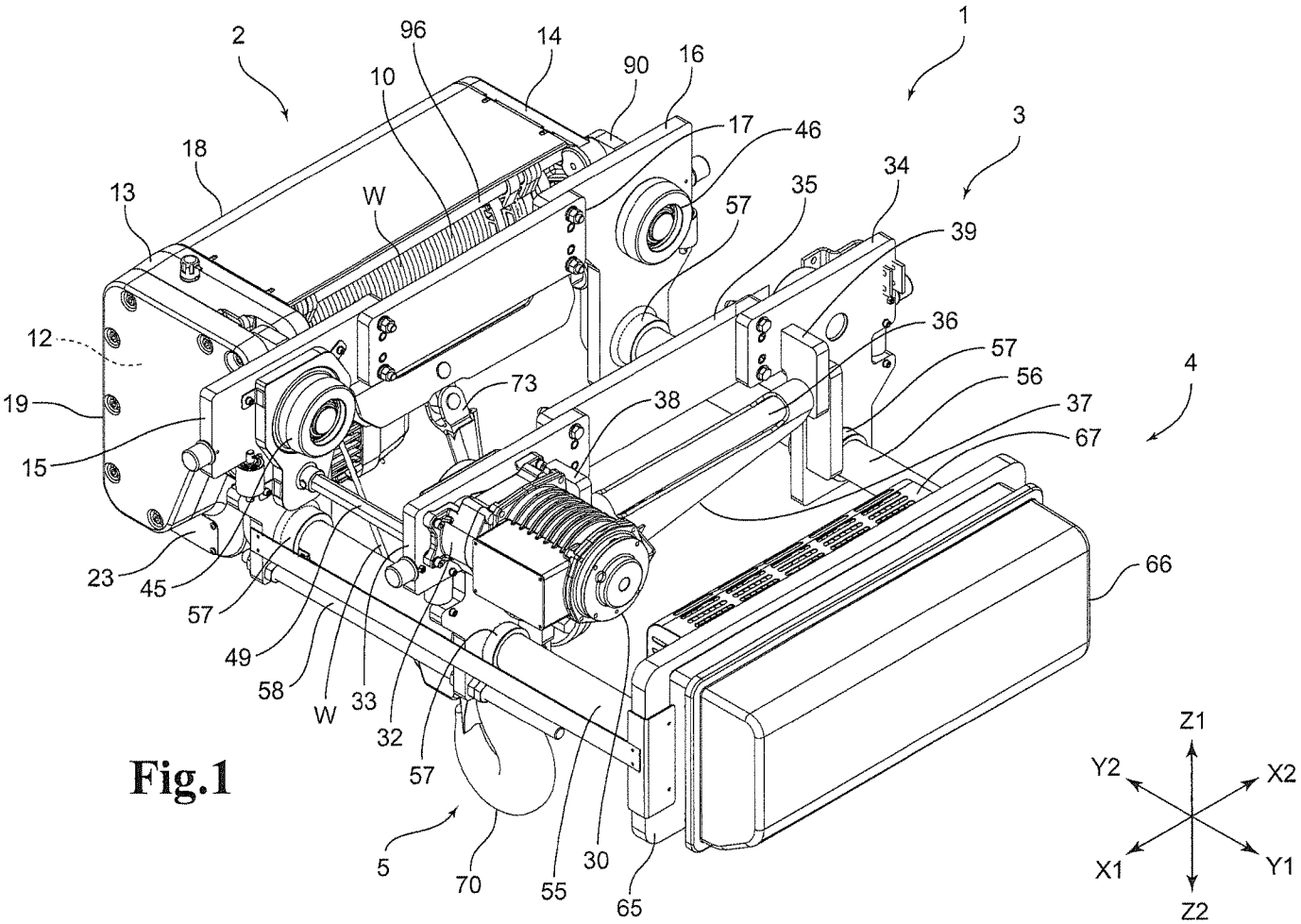
FIG. 1 is a perspective view illustrating the entire configuration of a rope hoist according to one embodiment of the present invention.

Hereinafter, a rope hoist 1 according to one embodiment of the present invention will be described while referring to the drawings. Note that the description will be made hereinbelow by using XYZ orthogonal coordinate system according to need. In the XYZ orthogonal coordinate system, an X direction indicates a direction in which a rail guiding movement of the rope hoist 1 extends, in which an X1 side indicates a front side in the illustration of FIG. 1, and an X2 side indicates an opposite side of the X1 side. A Y direction indicates a direction orthogonal to the X direction, in which a Y1 side indicates a right side when seen from the X1 direction, and a Y2 side indicates a direction on the opposite side of the Y1 side. A Z direction indicates a vertical direction and a direction orthogonal to both of the X direction and the Y direction, in which a Z1 side indicates an upper side in the vertical direction, and a Z2 side indicates a lower side being an opposite side of the Z1 side.

(Configuration of Rope Hoist 1)

Figure 2:
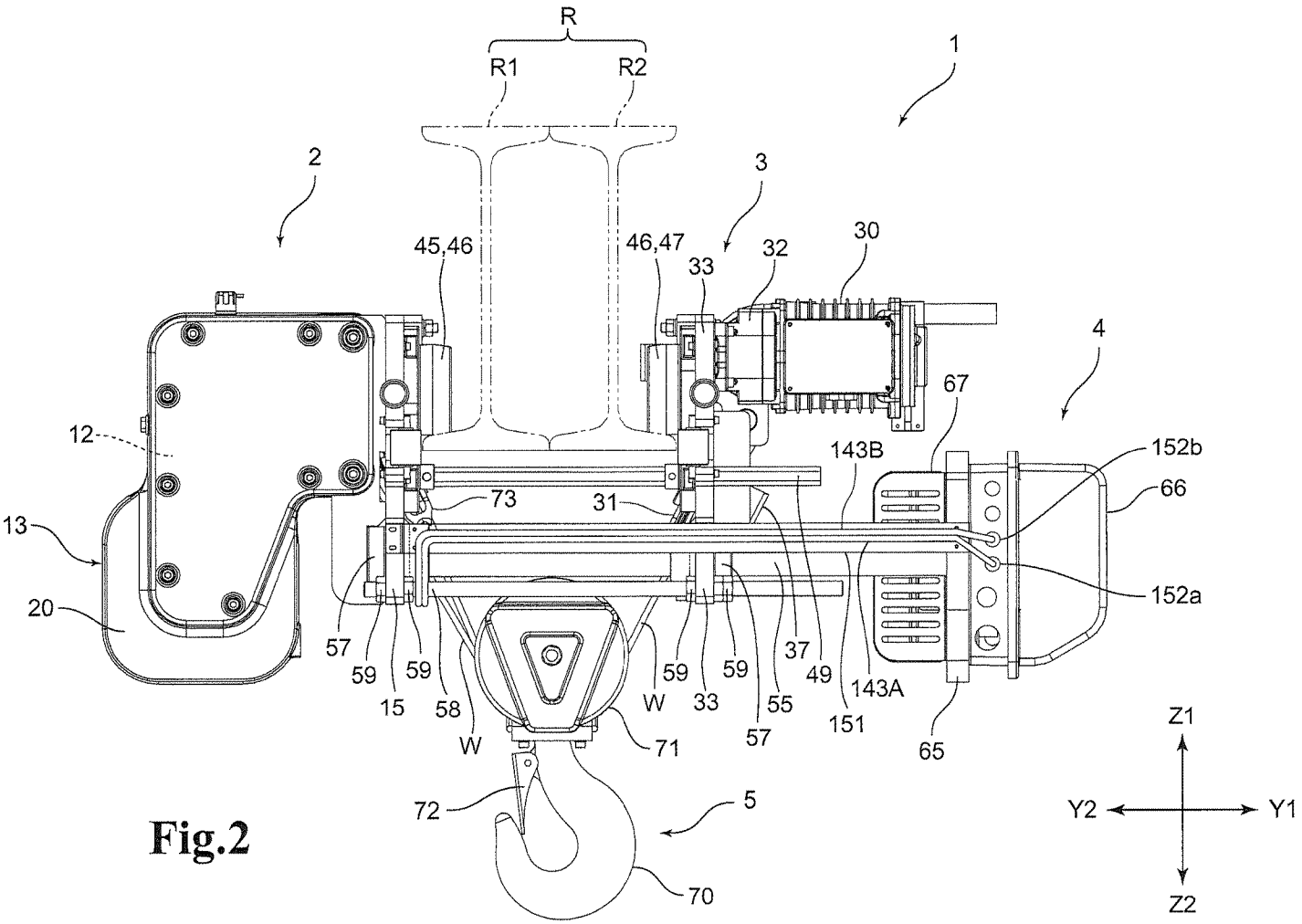
FIG. 2 is a front view illustrating the entire configuration of the rope hoist when seen from an X1 direction in FIG. 1.
Figure 3:
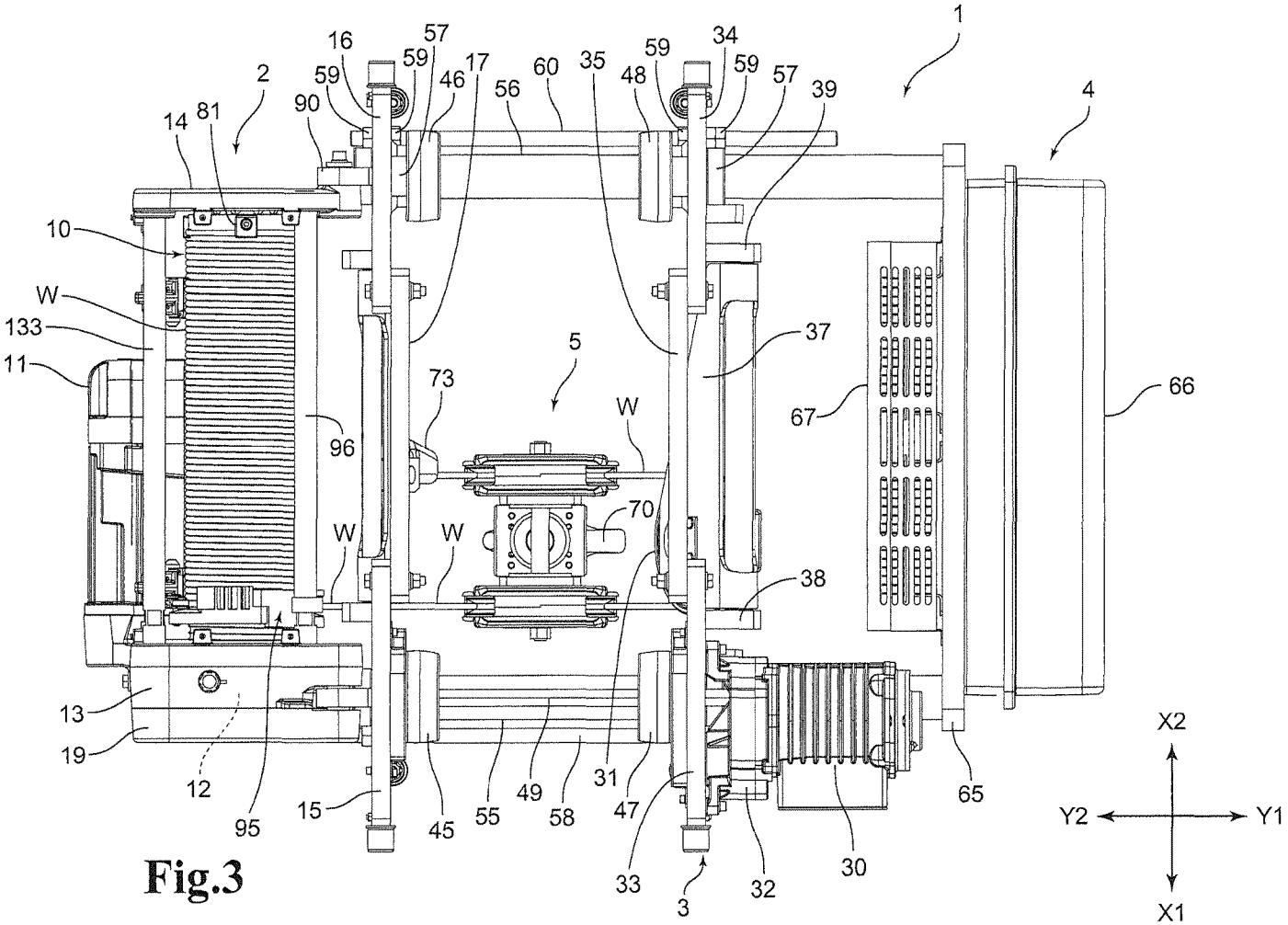
FIG. 3 is a plan view illustrating the entire configuration of the rope hoist when seen from a Z1 direction in FIG. 1.

FIG. 1 is a perspective view illustrating the entire configuration of the rope hoist 1 according to the one embodiment of the present invention. FIG. 2 is a front view illustrating the entire configuration of the rope hoist 1 when seen from the X1 direction in FIG. 1, and FIG. 3 is a plan view illustrating the entire configuration of the rope hoist 1 when seen from the Z1 direction in FIG. 1. As illustrated in FIG. 1 to FIG. 3, the rope hoist 1 is formed of a rope drum mechanism 2 arranged on the Y2 side, a trolley mechanism 3 arranged on the opposite side of the rope drum mechanism 2 while sandwiching a rail R (refer to FIG. 2), a control unit 4 arranged further on the Y1 side relative to the trolley mechanism 3, and a hook part 5 arranged on the lower side (in the Z2 direction) relative to the positions of the aforementioned components. From the control unit 4, a not-illustrated remote control switch for operation is dangled in the lower direction of the control unit 4.

The rope drum mechanism 2 includes a rope drum 10, a drum motor 11 rotating the rope drum 10 (refer to FIG. 3 and FIG. 4), and a reduction gear mechanism 12 interposed between the rope drum 10 and the drum motor 11 (refer to FIG. 4), as its main components. The rope drum 10 is a drum-shaped member around which a wire rope W is wound, and on an outer periphery thereof, rope grooves 80 to which the wire rope W is fitted are formed (refer to FIG. 4 and FIG. 5). Details of the rope drum 10 will be described later while referring to FIG. 4.

The reduction gear mechanism 12 coupling one end portion of the rope drum 10 and the drum motor 11 is attached on a side of a main body part 13 being one end frame member, and the other end portion of the rope drum 10 is attached to a back frame 14 being the other end frame member. Further, the main body part 13 is attached to a frame 15, and the back frame 14 is attached to a frame 16. The frame 15 and the frame 16 are fixed to a beam 17 to be a beam at both end portions in the X direction of the beam 17, to be formed as an integrated frame which is parallel to the rope drum 10. An upper surface (in the Z1 direction), a side surface in the Y2 direction, and a lower surface (in the Z2 direction) of the rope drum 10 are covered by a main body cover 18, and the main body cover 18 is structured such that it is not brought into contact with the rope drum 10 and the wire rope W. Note that FIG. 3 is a view in which the main body cover 18 is omitted.

On the side (X1 side) of the main body part 13, opposite to the side on which the rope drum 10 is arranged, the reduction gear mechanism 12 is arranged. The reduction gear mechanism 12 is housed in a space formed by the main body part 13 and a gear case 19. A configuration of the reduction gear mechanism 12 will be described later while referring to FIG. 4.

To the rope drum mechanism 2, the trolley mechanism 3 is coupled. As illustrated in FIG. 3, the trolley mechanism 3 includes four wheels 45, 46, 47, 48 for allowing the rope hoist 1 to travel along the rail R, a traversing motor 30 driving the wheels 45, 47, out of these wheels 45, 46, 47, 48, frames 15, 16 supporting the wheels 45, 46, respectively, and frames 33, 34 supporting the wheels 47, 48, respectively. The frames 15, 16, and the frames 33, 34, are coupled by coupling shafts 55, 56. The traversing motor 30 includes a reduction gear part 32, and is fixed to the frame 33. The frame 33 is provided to face the frame 15 on the rope drum mechanism 2 side. Further, the frame 34 is provided to face the frame 16 on the rope drum mechanism 2 side. Further, the frame 33 and the frame 34 are fixed to a beam 35 to be a beam at both end portions in the X direction of the beam 35, to be formed as an integrated frame which is parallel to the rope drum 10.

The wheels 45, 46 are arranged at the same height position in the Z direction, and are arranged as being separated from each other in the X direction. Meanwhile, the wheels 47, 48 are also arranged at the same height position in the Z direction (which is also the same height position as that of the wheels 45, 46), and are arranged while being separated from each other in the X direction. Further, the wheel 45 and the wheel 47, and the wheel 46 and the wheel 48, are respectively arranged at the same position in the X direction. Note that the wheel 45 and the wheel 47 are driving wheels, one gear (not illustrated) is provided on the frame 15 side of the wheel 45, and another gear (not illustrated) is provided on the frame 33 side of the wheel 47. To both ends of a drive shaft 49 having a hexagonal cross section, there are arranged gears which engage with the wheel 45 and the wheel 47, respectively, being the driving wheels. A gear of an output shaft of the reduction gear part 32 of the traversing motor 30 drives the wheel 47 being the driving wheel, and the driving force is transmitted to the wheel 45 being another of the driving wheels, via the drive shaft 49. The wheels 46, 48 are driven wheels having no driving mechanism.

The coupling shafts 55, 56 can adjust an interval between the frames 15, 16, and the frames 33, 34, which face each other, in accordance with a width of the rail R. Further, the coupling shafts 55, 56 fix the frames 15, 16, and the frames 33, 34, to make the frames locate at the predetermined positions and in predetermined postures, so that the wheels 45, 46, 47, 48 are not derailed from the rail R even if a load is applied. Note that to the frames 15, 16 on the Y2 side of the trolley mechanism 3 of the coupling shafts 55, 56, the rope drum mechanism 2 is attached, and to the frames 33, 34 on the Y1 side, a counterweight 65 and the control unit 4 are attached. Note that FIG. 2 exemplifies a case where the rail R illustrated in FIG. 2 is formed of a rail R1 and a rail R2. As illustrated in FIG. 1, the coupling shaft 56 is supported by the frame 16 and the frame 34 via coupling shaft bushes 57, and the coupling shaft 55 is supported by the frame 15 and the frame 33 via coupling shaft bushes 57. Note that the trolley mechanism 3 can move in the Y direction along the coupling shafts 55, 56, with respect to the rope drum mechanism 2. A distance adjustment between the rope drum mechanism 2 and the trolley mechanism 3 is conducted by adjust bolts 58, 60. As illustrated in FIG. 2 and FIG. 3, the adjust bolt 58 is inserted into through holes provided on the frame 15 and the frame 33, nuts 59 are fastened from both sides in the Y direction of the frame 15 to fix the adjust bolt 58 on the rope drum mechanism 2 side, and nuts 59 are fastened from both sides in the Y direction of the frame 33 to fix the adjust bolt 58. Also on the coupling shaft 56 side, similar to the coupling shaft 55, the adjust bolt 60 is inserted into through holes provided on the frame 16 and the frame 34, nuts 59 are fastened from both sides in the Y direction of the frame 16 to fix the adjust bolt 60 on the rope drum mechanism 2 side, and nuts 59 are fastened from both sides in the Y direction of the frame 34 to fix the adjust bolt 60. It is designed such that by loosening the nuts 59, the distance between the frames 15, 16 on the rope drum mechanism 2 side, and the frames 33, 34 on the control unit 4 side, can be easily adjusted. Note that it is preferable that either of or both of the rope drum mechanism 2 side and the trolley mechanism 3 side employ a double nut structure, from a viewpoint of prevention of loosening of the nuts 59.

As illustrated in FIG. 1 to FIG. 3, the control unit 4 is arranged on end portions in the Y1 direction of the coupling shafts 55, 56. The control unit 4 has a control circuit part 66 which performs inverter control on the drum motor 11, and a braking resistor part 67 which gives braking resistance in the inverter control. Further, to the end portions in the Y1 direction of the coupling shafts 55, 56, the counterweight 65 is attached, and the control circuit part 66 is housed in an electric equipment box and attached to a surface in the Y1 direction of the counterweight 65. Meanwhile, a resistor which forms a part of the braking resistor part 67 is attached to a surface in the Y2 direction of the counterweight 65, and protected by a resistor cover. The counterweight 65 is provided to achieve a balance between weight in the Y1 direction and weight in the Y2 direction when the rope hoist 1 is suspended to the rail R.

As illustrated in FIG. 2, the hook part 5 is suspended by the wire rope W at the lower side (in the Z2 direction) relative to the positions of the respective mechanisms (the rope drum mechanism 2, the trolley mechanism 3, and the control unit 4). The hook part 5 is mainly formed of a hook 70, a hook sheave 71, and a lever 72. The lever 72 is provided to prevent a cargo suspension rope or the like from coming off the hook 70 when the cargo is suspended from the hook 70. As illustrated in FIG. 1 to FIG. 3, in the rope hoist 1 in the present embodiment, one end of the wire rope W is fixed to the rope drum 10 by a rope pressing metal fitting 81, the wire rope W is wound around the rope drum 10 along a rope groove 80 (refer to FIG. 4) from the metal fitting (refer to FIG. 4), and an end of the wire rope W dangled from the rope drum 10 is fixed to a rope fixing metal fitting 73. An intermediate sheave 31 is arranged between the wire rope W dangled from the rope drum 10 and a fixing part formed of the rope fixing metal fitting 73, and the hook sheave 71 is suspended by both of the wire rope W positioned between a portion at which the wire rope W is dangled from the rope drum 10 and the intermediate sheave 31, and the wire rope W positioned between the rope fixing metal fitting 73 and the intermediate sheave 31. Such a configuration corresponds to one of four-fall type (so-called 4/1 reeving type) in which one wire rope is used to suspend the hook part 5 with four wire ropes. The intermediate sheave 31 is attached to a sheave hanger 37 supported by an intermediate sheave support shaft 36, and can rotate in an orthogonal direction with respect to the intermediate sheave support shaft 36. Note that the intermediate sheave support shaft 36 is axially fixed between a frame 38 which is fixed to be orthogonal to the frame 33 and a frame 39 which is fixed to be orthogonal to the frame 34. Next, a configuration of the rope drum 10 will be described while referring to FIG. 4.

Figure 4:
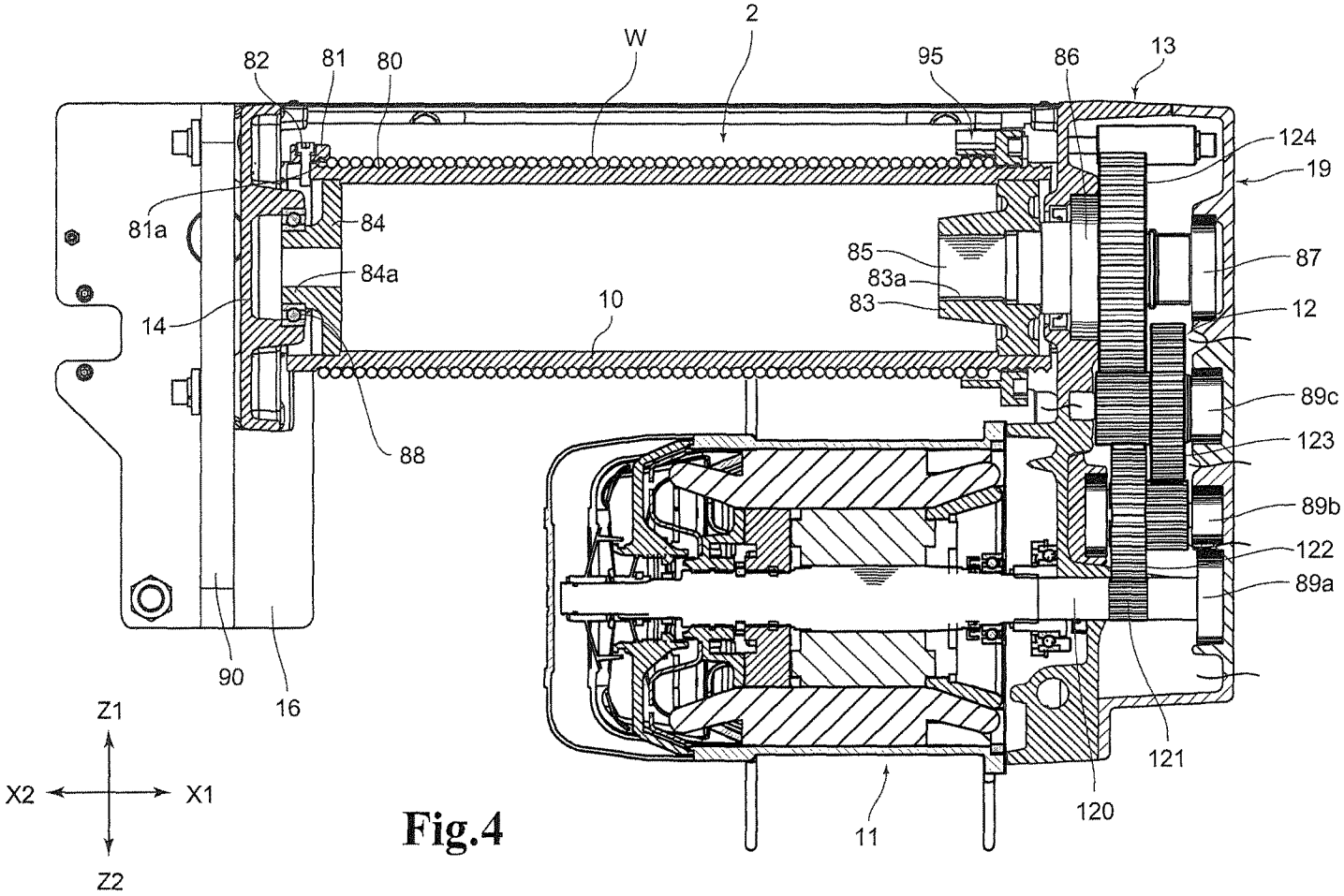
FIG. 4 is a sectional view illustrating a rope drum mechanism and a reduction gear mechanism which are components of the rope hoist illustrated in FIG. 1.

FIG. 4 is a sectional view illustrating the rope drum mechanism 2 and the reduction gear mechanism 12 which are the components of the rope hoist 1 illustrated in FIG. 1. As illustrated in FIG. 4, the rope drum 10 is a drum-shaped member around which the wire rope W is wound, and on an outer periphery thereof, there are formed the rope grooves 80 with which the wire rope W is wound around the rope drum 10 in an aligned manner. A depth of the rope groove 80 is set in accordance with a radius of the wire rope W. Further, the rope grooves 80 are formed to allow the wire rope W to wind in an aligned manner in a state where the wire rope W is not overlapped (in a single-wind state).

Note that to the end portion on the X2 side of the rope drum 10, the rope pressing metal fitting 81 for fixing the one end side of the wire rope W is attached. The rope pressing metal fitting 81 includes a recess 81*a* at which the wire rope W is positioned, and in a state where the wire rope W is positioned at the recess 81*a*, a screw 82 being a fastening means is firmly screwed in the rope drum 10. Consequently, the one end side of the wire rope W is fixed to the rope drum 10.

Further, to the end portion on the X1 side and the end portion on the X2 side of the rope drum 10, rotatable support parts 83, 84 are attached, respectively. As illustrated in FIG. 4, on the rotatable support part 83 on the X1 side, there is provided a rotation shaft hole 83*a* to which a drum rotation shaft 85 is coupled by spline coupling, for example. The drum rotation shaft 85 is attached to the main body part 13 and the gear case 19 via bearings 86, 87 as shaft bearings. Further, to an annular projecting portion 84*a* at a center portion in a radial direction of the rotatable support part 84 on the X2 side, a bearing 88 is attached, and an outer peripheral side of the bearing 88 is attached to the back frame 14. The back frame 14 is attached to the frame 16 via a joint plate 90 (refer to FIG. 3). Consequently, the rope drum 10 is rotatably supported by the main body part 13 and the back frame 14.

Subsequently, the configuration of the reduction gear mechanism 12 will be described while referring to FIG. 4. The reduction gear mechanism 12 includes: a pinion gear 121 attached to an output shaft 120 of the drum motor 11, the output shaft 120 penetrating from the rear side (the X2 direction) to the front side (the X1 direction) of the main body part 13; a gear 122 which engages with the pinion gear 121; a gear 123 which engages with the gear 122; and a gear 124 which engages with the gear 123. A rotation shaft of the gear 124 corresponds to the drum rotation shaft 85, and is fitted to the rotation shaft hole 83*a* with the spline structure. The output shaft 120 is rotatably supported by a bearing 89*a*, the gear 122 is rotatably supported by a bearing 89*b*, and the gear 123 is rotatably supported by a bearing 89*c*. The drum rotation shaft 85 (the gear 124) is rotatably supported by the bearings 86, 87 which are provided to the main body part 13 and the gear case 19, respectively. Note that a gear train formed of the pinion gear 121 and the gears 122, 123, 124, corresponds to a reduction gear train. Next, a configuration of the rope guide mechanism 95 will be described.

Figure 5:
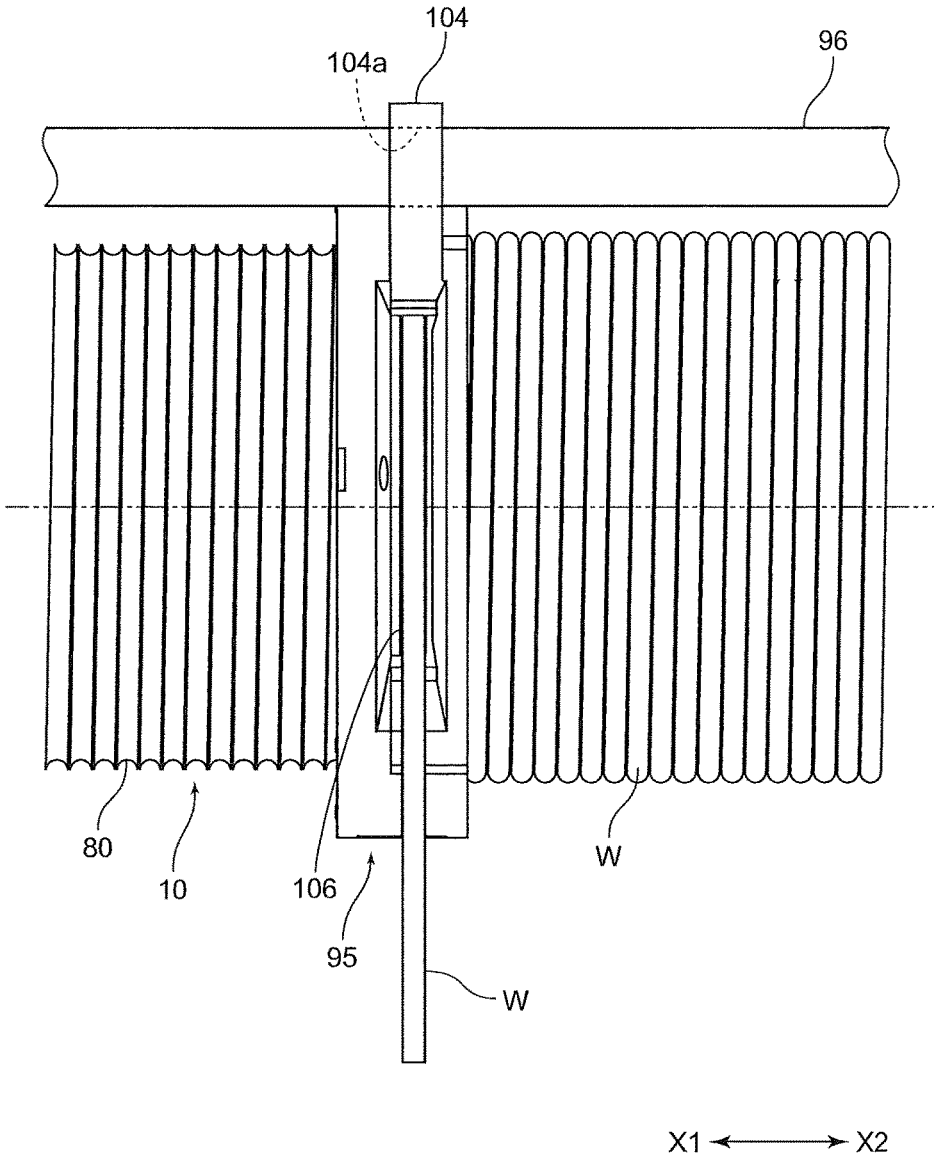
FIG. 5 is a partial side view of a rope drum for illustrating the vicinity of a rope guide mechanism which is a component of the rope hoist illustrated in FIG. 1.
Figure 6:
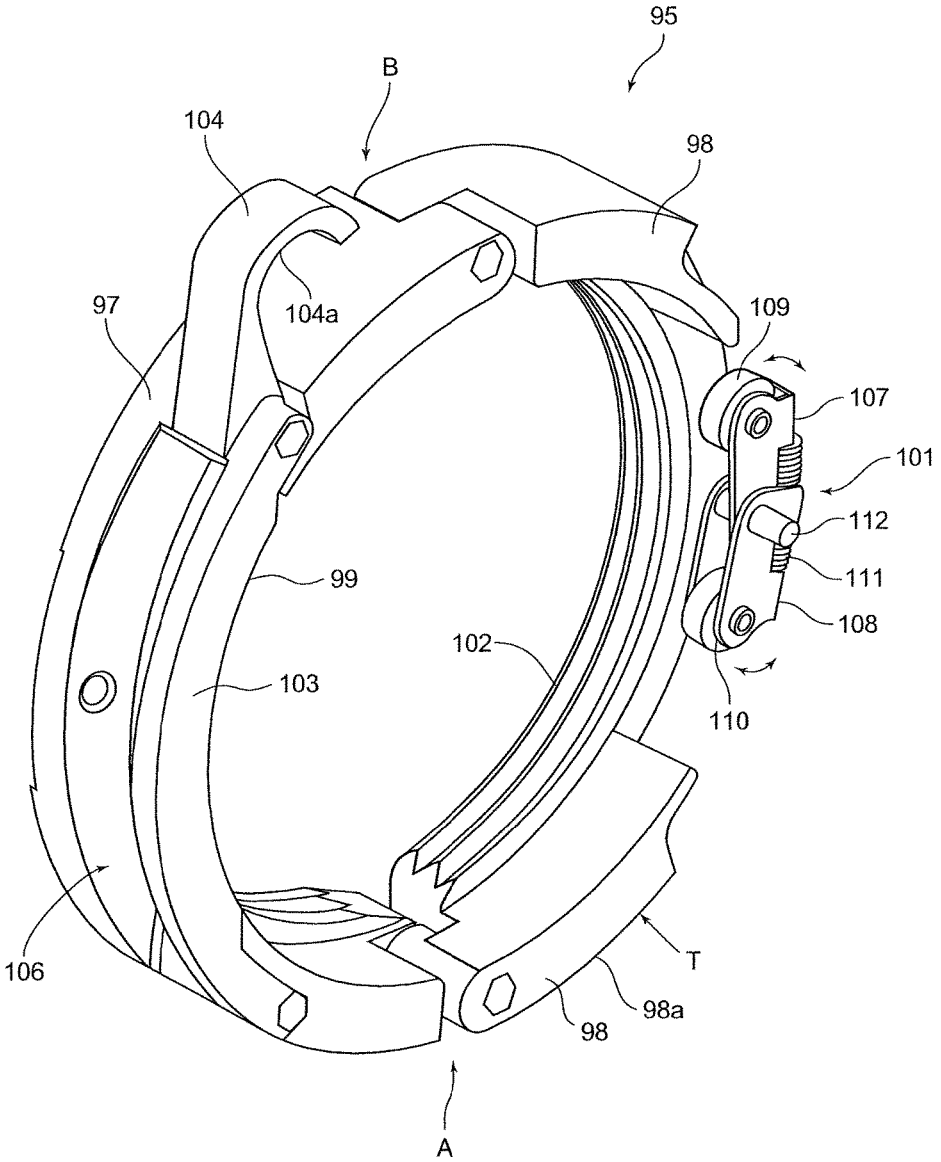
FIG. 6 is a perspective view illustrating the rope guide mechanism which is the component of the rope hoist illustrated in FIG. 1.

FIG. 5 is a partial side view of the rope drum 10 for illustrating the vicinity of the rope guide mechanism 95 illustrated in FIG. 1. FIG. 6 is a perspective view illustrating the rope guide mechanism 95 which is the component of the rope hoist 1 illustrated in FIG. 1. As illustrated in FIG. 5, the rope guide mechanism 95 being a moving member always moves to a winding end position which moves in accordance with the winding amount of the wire rope W (a rotation amount of the rope drum 10). Note that as illustrated in FIG. 3, a moving member support shaft 96 is supported by the main body part 13 and the back frame 14. The moving member support shaft 96 is arranged in a direction in which the wire rope W is dangled, and in a direction opposite by 180 degrees to the moving member support shaft 96 by sandwiching the rope drum 10, there is provided a support shaft 133. The support shafts 96, 133 regulate the position (interval) in the X direction and a degree of parallelization of the back frame 14 with respect to the main body part 13.

Further, as illustrated in FIG. 6, the rope guide mechanism 95 has a ring shape as a whole, and includes a first guide member 97, a second guide member 98, a third guide member 99, and a rope pressing mechanism 101. The rope guide mechanism 95 has a shape as if a ring is divided into two parts of the first guide member 97 and the second guide member 98, and is configured in a manner that mutual divided end surfaces are abutted to be assembled. Further, the first guide member 97 and the second guide member 98 are coupled at abutted portions A, B. If the abutted portion A is set to have a hinge structure, the abutted portion B corresponds to an abutted fixing portion, and is fixed by using a bolt and a nut and the like. Further, it is possible to employ the reverse configuration regarding the abutted portion and the fixing portion. On an inner peripheral surface of the ring shape formed when the first guide member 97 and the second guide member 98 are assembled, there is formed a convex strip 102 which fits into and slides along the rope grooves 80 formed on the rope drum 10. The rope grooves 80 formed on the rope drum 10 and the convex strip 102 formed on the rope guide mechanism 95 have the same pitch and lead.

To the first guide member 97, the third guide member 99 is attached. The third guide member 99 is fixed to the first guide member 97 at both ends of a fixing base part 103 by a bolt and a nut and the like. On one end portion of the third guide member 99, there is formed a hook-shaped rotation regulating part 104 which projects in an outer peripheral direction. When the hook-shaped rotation regulating part 104 is fitted to the moving member support shaft 96, the rotation of the rope guide mechanism 95 is regulated. An inner surface 104*a* of the rotation regulating part 104 also becomes a surface which slides along the moving member support shaft 96 (refer to FIG. 5). By assembling the second guide member 98 and the third guide member 99, a guide hole 106 in a shape of long hole is formed. As illustrated in FIG. 5, the guide hole 106 is a hole for allowing the wire rope W which is wound around the rope drum 10, to extend to the outside. To the second guide member 98, the rope pressing mechanism 101 is attached.

Note that the first guide member 97 and the second guide member 98 are formed so that their outer peripheral surfaces make one circle in a state where they are assembled. In the present embodiment, in an outer peripheral surface 98*a* of the second guide member 98 on a lower side of the rope pressing mechanism 101, a contact position T at which a detector 132 (refer to FIG. 8 and FIG. 9) of limit switch mechanisms 130, 131 to be described later (refer to FIG. 8) is brought into contact with the outer peripheral surface 98*a*, is regulated.

The rope pressing mechanism 101 includes arms 107, 108, rollers 109, 110, and a compression spring 111. To one tip portion of the arm 107, the roller 109 is rotatably attached via a ball bearing (not illustrated). Further, to one end portion of the arm 108, the roller 110 is rotatably attached via a ball bearing (not illustrated). End portions, to which the rollers are not attached, of the arm 107 and the arm 108, are attached to the second guide member 98 by a support shaft 112. The arms 107, 108 can swing around the support shaft 112 as a rotation center (a swing direction is indicated by arrow marks in FIG. 6). Further, the rollers 109, 110 are swung toward the rope drum 10 side by the compression spring 111 interposed between the arm 107 and the arm 108, to thereby bias the wire rope W from the outer peripheral side. The rope pressing mechanism 101 presses the wire rope W wound around the rope drum 10 against the rope groove 80 to prevent the wire rope W from projecting outward, and prevents the wire rope W from coming off the rope groove 80 of the rope drum 10, and random winding such that the wire rope W is wound as being overlapped.

The rope guide mechanism 95 can move in the X direction in conjunction with the rotation of the rope drum 10 (refer to FIG. 5). Specifically, the rope guide mechanism 95 operates in conjunction with the movement of the wire rope W in a range of the wind-up position or the unwind position of the wire rope W. The present embodiment includes limit switch mechanisms 130, 131 for stopping the drum motor 11 when the wire rope W is wound-up to a predetermined position or when the wire rope W is unwound to a predetermined position.

Figure 7:
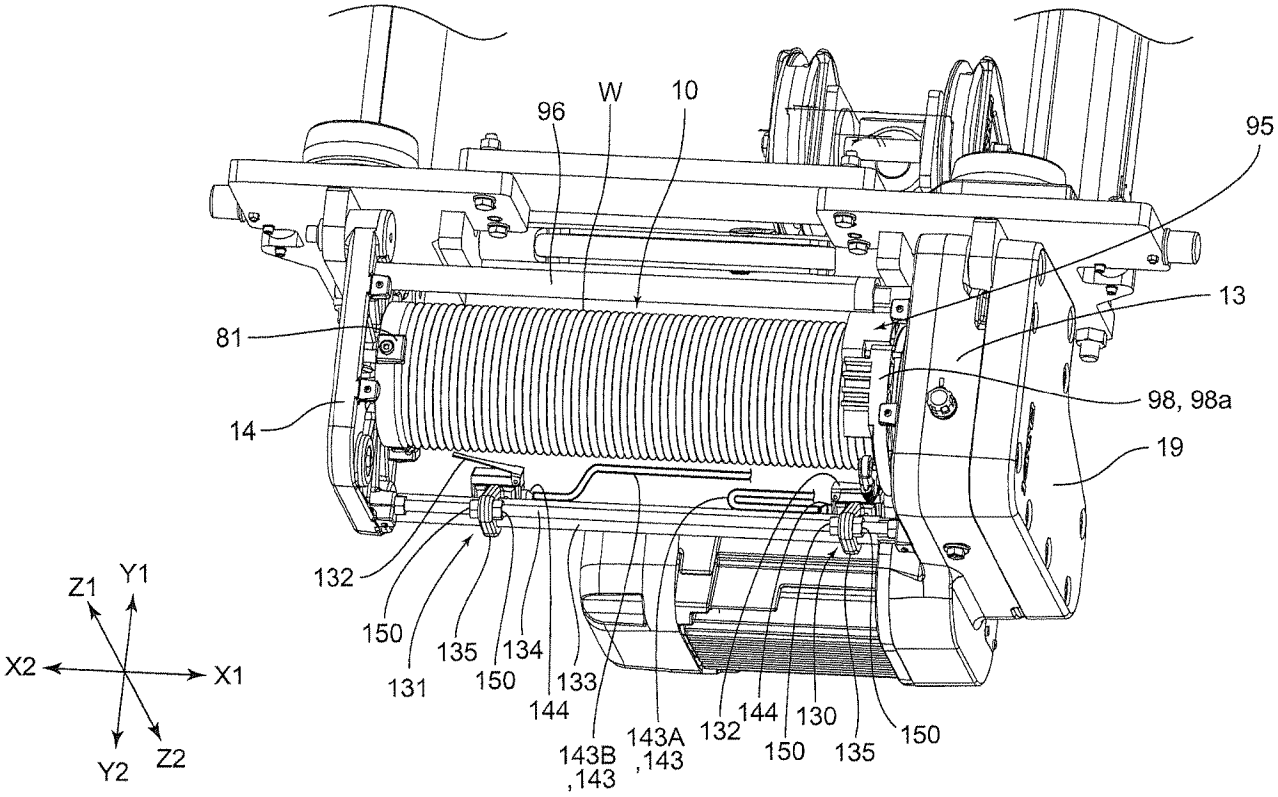
FIG. 7 is a perspective view when a relation between the rope drum and limit switch mechanisms which are the components of the rope hoist illustrated in FIG. 1, is seen from above in a Y2 direction.

FIG. 7 is a perspective view when a relation between the rope drum 10 and the limit switch mechanisms 130, 131 which are the components of the rope hoist 1 illustrated in FIG. 1, is seen from above in the Y2 direction. As illustrated in FIG. 7, the limit switch mechanism 130 is arranged at an end portion in the X1 direction of the rope drum 10. On the other hand, the limit switch mechanism 131 is arranged in the X2 direction of the rope drum 10 (on a fixed end side of the wire rope W). The state in FIG. 7 illustrates a state where the wire rope W is wound-up to a predetermined position being a wind-up limit, and the rope guide mechanism 95 is moved to the wind-up position of the wire rope W. At this time, the outer peripheral surface 98*a* of the second guide member 98 of the rope guide mechanism 95 presses the detector 132 of the limit switch mechanism 130, concretely, a switch lever part 149 (refer to FIG. 8), to thereby produce a state of switch-on (ON, namely, the rope guide mechanism 95 at the wind-up position of the wire rope W is detected), and the drum motor 11 is stopped quickly. The outer peripheral portion of the second guide member 98 presses the detector 132 at the contact position T illustrated in FIG. 6.

On the other hand, regarding the limit switch mechanism 131 on the X2 side, since the rope guide mechanism 95 is not positioned at the position of the limit switch mechanism 131, the detector 132 is in free state, and there is produced a state of switch-off (OFF, namely, the rope guide mechanism 95 at the wind-up position of the wire rope W is not detected), as illustrated in FIG. 7. Here, although illustration is omitted, when the wire rope W is unwound and the rope guide mechanism 95 reaches the position of the limit switch mechanism 131, the second guide member 98 presses and moves the detector 132, to thereby produce a state of switch-ON (namely, the rope guide mechanism 95 at the unwind position of the wire rope W is detected). Consequently, the drum motor 11 is stopped quickly. Also in this case, the second guide member 98 presses and moves the detector 132 at the contact position T (refer to FIG. 6). At this time, the limit switch mechanism 130 is in the OFF state, since the detector 132 and the second guide member 98 are not brought into contact with each other.

Note that the limit switch mechanisms 130, 131 have a common configuration, although there is a difference that the tip portion of the detector 132 is directed to the X1 direction or the X2 direction. The tip portion of the detector 132 of the limit switch mechanism 130 is directed to the wind-up moving direction of the rope guide mechanism 95 (the X1 direction), and the detector 132 never comes off the rope guide mechanism 95 in the state where the drum motor 11 is stopped. On the other hand, the tip portion of the detector 132 of the limit switch mechanism 131 is directed to the direction of the rope pressing metal fitting 81 (the X2 direction), and in the state where the rope guide mechanism 95 is moved to the position of the limit switch mechanism 131 and the second guide member 98 presses and moves the tip portion of the detector 132 to stop the drum motor 11, the detector 132 never comes off the rope guide mechanism 95. The detailed configuration of the limit switch mechanisms 130, 131 will be described later with reference to FIG. 8.

When a limit switch metal fitting 135 is attached to both of the support shaft 133 and a limit switch bolt 134 being a limit switch fixing bar, a position in the Y direction and inclination with respect to the rope drum 10 of each of the limit switch mechanisms 130, 131 are defined. Each of the support shaft 133 and the limit switch bolt 134 is supported by a so-called both-end support structure in which the end portion in the X1 direction is supported by the main body part 13 being one end frame member, and the end portion in the X2 direction is supported by the back frame 14 being the other end frame member.

However, although illustration is omitted, the limit switch bolt 134 can be set to have a so-called cantilever support structure. For example, it is possible to employ a structure in which the limit switch bolt 134 is extended from the main body part 13, and the tip portion thereof is not supported, a structure in which the limit switch bolt 134 is extended from the back frame 14, and the tip portion thereof is not supported, and the like. This is because, by fixing the limit switch mechanisms 130, 131 between the limit switch bolt 134 and the support shaft 133, the limit switch bolt 134 substantially has the both-end support structure. Next, the detailed configuration of the limit switch mechanism 130 will be described while referring to FIG. 8.

Figure 8:
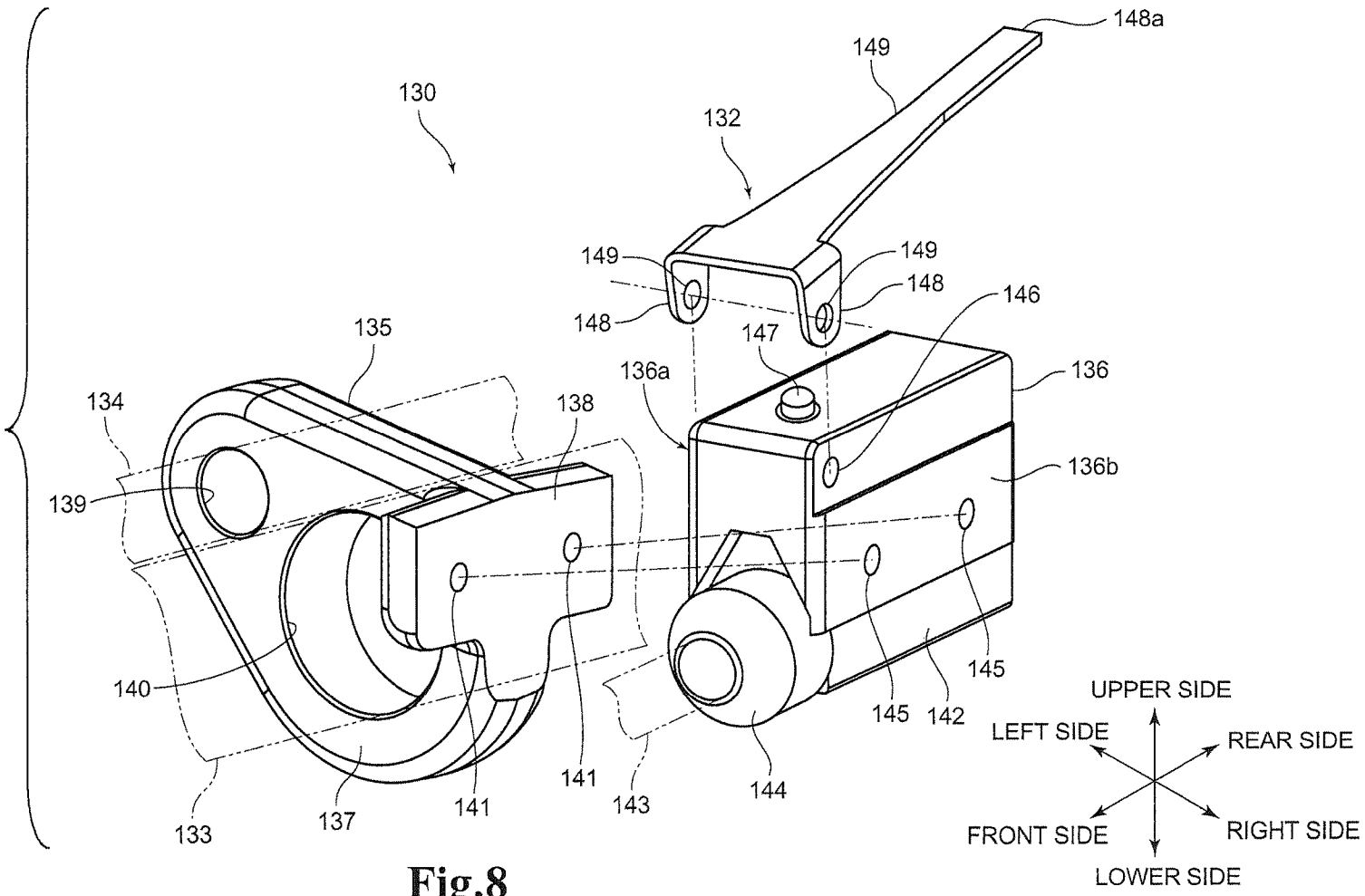
FIG. 8 is an exploded perspective view illustrating a configuration of the limit switch mechanism which is the component of the rope hoist illustrated in FIG. 1.

FIG. 8 is an exploded perspective view illustrating the configuration of the limit switch mechanism 130. FIG. 8 indicates definitions of a front side, a rear side, a left side, a right side, an upper side, and a lower side, by using arrow marks, for easy explanation. As illustrated in FIG. 8, the limit switch mechanism 130 includes the limit switch metal fitting 135, a limit switch main body part 136, and the detector 132. The limit switch metal fitting 135 includes a main body part 137 extended in the right-and-left direction in FIG. 8, and a switch main body attachment surface 138 positioned orthogonal to the extending direction of the main body part 137. On the main body part 137, a through hole 139 into which the limit switch bolt 134 is inserted, and a through hole 140 into which the support shaft 133 is inserted, are opened. Further, on the switch main body attachment surface 138, two screw holes 141 for attaching the limit switch main body part 136, are opened.

The limit switch main body part 136 includes a box-shaped main body part 142 housing a not-illustrated switch mechanism, and a cable holder part 144 from which a cable 143 connected to the switch mechanism is taken out to the outside. On the main body part 142, two through holes 145 penetrating in the right-and-left direction in FIG. 8 are opened, and at a position above and on the front side of the through hole 145, a through hole 146 penetrating in the right-and-left direction for fixing the detector 132 is opened. Further, from an upper surface of the limit switch main body part 136, a switch part 147 projects. The switch part 147 includes a spring (not-illustrated) in the inside thereof, and the spring urges the switch part 147 upward. It is configured such that when the switch part 147 is pressed downward, the switch mechanism is turned to be an ON state, and when the pressing-down load is eliminated, the switch part 147 returns to its original position, so that the switch mechanism is turned to be an OFF state.

Note that in the present embodiment, the independent through holes 139, 140 are provided on the limit switch metal fitting 135, but, the through hole 139 and the through hole 140 may be connected to be an oval hole. Further, the through holes are only required to have a shape such that the support shaft 133 and the limit switch bolt 134 can be inserted, and the posture of the limit switch metal fitting 135 can be regulated.

The detector 132 is provided with an attachment part 148 which is bent in a substantially U shape, and the switch lever part 149 extended rearward from an upper surface of the attachment part. The switch lever part 149 has elasticity such as a leaf spring. In a direction of tips of the portions, which are bent downward, of the attachment part 148, through holes 149, 149 are opened.

Subsequently, a method of assembling the limit switch mechanism 130 will be described while referring to FIG. 8. When the position of the through hole 149 is aligned with the position of the through hole 146 opened on the limit switch main body part 136, and a not-illustrated pin or the like is pushed into the through holes 149, 146, the detector 132 is fixed to the limit switch main body part 136. Note that the detector 132 can rotate around the pin as a rotation shaft. Further, in the state where the detector 132 is attached to the limit switch main body part 136, the switch part 147 pushes the detector 132 up by a biasing force of the spring (not-illustrated) inside the limit switch main body part 136, to thereby produce a state of switch OFF.

In the state where the detector 132 is attached to the limit switch main body part 136, the limit switch main body part 136 is attached to the limit switch metal fitting 135. A left side surface **136*a* of the limit switch main body part 136 is abutted against the switch main body attachment surface 138 of the limit switch metal fitting 135, the positions of the screw holes 141 opened on the limit switch metal fitting 135 and the through holes 145 opened on the limit switch main body part 136 are respectively aligned, and not-illustrated screws are inserted into the through holes 145 from a right side surface 136*b* side of the limit switch main body part 136, to thereby perform screwing. The limit switch mechanism 130 is formed in the manner as described above. Each of the through holes 139, 140 of the limit switch metal fitting 135 has a clearance which is wide enough to allow the limit switch metal fitting 135 to move in the X direction (axial direction), when the limit switch metal fitting 135 is in a posture which is substantially orthogonal to the support shaft 133 and the limit switch bolt 134**.

Note that the limit switch mechanism 131 is fixed through a method similar to the method of fixing the limit switch mechanism 130, in a manner that the right side surface **136*b* of the limit switch main body part 136 to which the detector 132 is attached, is abutted against the switch main body attachment surface 138 of the limit switch metal fitting 135. Therefore, a direction in the front-and-rear direction of the detector 132 in the limit switch mechanism 130 and that in the limit switch mechanism 131** are reversed.

Figure 9:
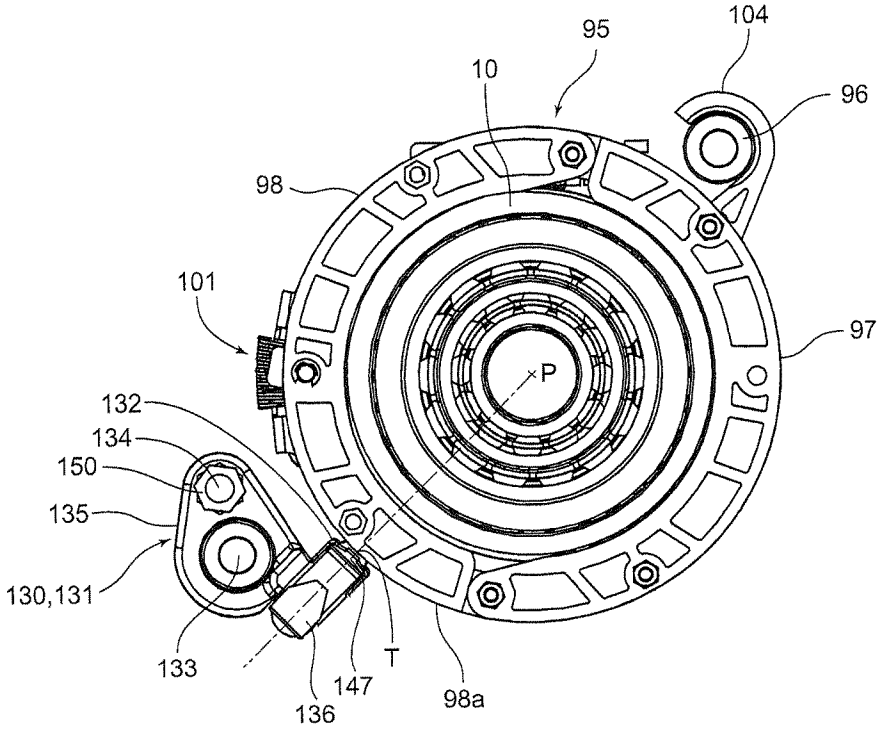
FIG. 9 is a view illustrating a relation between the rope guide mechanism and the limit switch mechanisms which are the components of the rope hoist illustrated in FIG. 1.

FIG. 9 is a view illustrating a relation between the rope guide mechanism 95 and the limit switch mechanisms 130, 131, and a view when seen from the X1 direction in FIG. 7. As illustrated in FIG. 7 to FIG. 9, each of the limit switch mechanisms 130, 131 is fixed to the predetermined position in the X direction of the support shaft 133 when, in the state where the support shaft 133 and the limit switch bolt 134 being the limit switch fixing bar (shaft member) are inserted into the through holes 139, 140 of the limit switch metal fitting 135, nuts 150, 150 being the fixing means for fixing the position in the axial direction are fastened to the limit switch bolt 134 with sandwiching the limit switch metal fitting 135 from both sides in the X direction of the metal fitting. Here, the front-and-rear direction of the limit switch main body part 136 (refer to FIG. 8) is fixed to be parallel to the axial direction of the support shaft 133 (the X direction in FIG. 7), and the switch part 147 is directed to a center position P of the rope drum 10 (refer to FIG. 9).

The limit switch fixing bar may employ, other than the bolt, a round bar, or a bar having a polygonal cross section, and the fixing means is attached around the limit switch fixing bar to be fitted to or fastened to the limit fixing bar, and sandwiches the limit switch metal fitting from both sides of the metal fitting, to thereby fix the position in the axial direction of the limit switch metal fitting. As the fixing means, a snap ring, a tightening band, or the other means capable of regulating the position in the axial direction, namely, a stopper, may be used. By using the limit switch bolt 134 and the nuts 150, 150, as the limit switch fixing bar member and the fixing means, it becomes possible to easily perform fine adjustment of the position in the axial direction of the limit switch metal fitting 135, and to firmly fix the position after the adjustment. If the snap ring is used as the fixing means, a plurality of grooves to which the snap ring is fitted are previously formed on the outer periphery of the limit switch fixing bar, and by selecting a groove at a desired position from the plurality of grooves and making the snap ring fit to the groove, the position in the axial direction of the limit switch metal fitting is fixed in an adjustable manner.

The limit switch mechanisms 130, 131 can freely move in the X direction by loosening one or both of the nuts 150, and can arrange the rope drum 10 at an arbitrary position in the X direction. Therefore, by moving the limit switch mechanism 130, it is possible to freely change the wind-up limit position of the wire rope W, and by moving the limit switch mechanism 131, it is possible to freely change the unwind limit position. Further, it is possible to perform fine adjustment of the position in the X direction of the limit switch mechanisms 130, 131, with the use of the rotation amount of the nuts 150.

Next, wiring of cables 143 taken out from the respective limit switch mechanisms 130, 131 with respect to the control unit 4, will be described while referring to FIG. 2 and FIG. 7. As illustrated in FIG. 7, the cable holder part 144 of the limit switch mechanism 130 (refer to FIG. 8) is directed toward the X2 direction, so that the cable 143 taken out from the cable holder part 144 is once extended in the X2 direction, and then folded back in the U shape to be extended toward the X1 direction. Further, in the limit switch mechanism 131, the cable holder part 144 is directed toward the X1 direction, so that the cable 143 is extended in the X1 direction along the rope drum 10. Here, in order to distinguish the cable 143 of the limit switch mechanism 130 from the cable 143 of the limit switch mechanism 131, the cable of the limit switch mechanism 130 side is referred to as a cable 143A, and the cable of the limit switch mechanism 131 side is referred to as a cable 143B. In FIG. 7, a part of the cables 143A, 143B is illustrated, for the convenience of illustration. The cables 143A, 143B exit from the cable holder parts 144, and are wired toward the control unit 4.

As illustrated in FIG. 2, the cables 143A, 143B pass through a portion below (in the Z2 direction of) the frame 15 to be wired on the front side in the illustration of the rope hoist 1 (the X1 side in FIG. 1), the cables are extended toward the control unit 4 along a cable stay 151, and pass through holes 152*a*, 152*b* opened on an electric equipment box to be connected to predetermined terminal portions of the control circuit part 66. Note that each of the cables 143A, 143B includes two lead wires for switch detection. The cables 143A, 143B are fixed to the cable stay 151 by not-illustrated cable attachment metal fittings at the vicinity of a take-out portion from the control circuit part 66 and at an end portion on the rope drum mechanism 2 side. The cable stay 151 is fixed by screws to the frame 15 on the rope drum mechanism 2 side, and is fixed by screws to the counterweight 65 on the control unit 4 side. Note that in FIG. 1, the illustration of the cables 143A, 143B is omitted.

According to the rope hoist 1 described above, each of the limit switch mechanisms 130, 131 includes the limit switch metal fitting 135 into which both of the support shaft 133 and the limit switch fixing bar such as the limit switch bolt 134 are inserted, and the limit switch metal fitting 135 is sandwiched and fastened from both sides in the axial direction of the limit switch bolt 134 by the fixing means such as the nuts 150. The rope guide mechanism 95 moves in the axial direction (the X direction) with keeping a certain position with respect to the rope drum 10, while pressing the wire rope W against the rope drum 10 by using the rope pressing mechanism 101.

Consequently, the rope guide mechanism 95 is always at an accurate position with respect to the wind-up position or the unwind position of the wire rope W. The detector 132 of each of the limit switch mechanisms 130, 131 can be operated on the outer peripheral surface 98*a* of the rope guide mechanism 95, and the winding amount of the wire rope W can be accurately detected.

Further, if one or both of the nuts 150 are loosened, and then one of the nuts 150 is rotated, the movement amount of each of the limit switch mechanisms 130, 131 can be regulated by the rotation amount of the nut 150, and the fixing position of each of the limit switch mechanisms 130, 131 can be freely set with respect to the X direction (the wind-up direction or the unwind direction) of the rope drum 10, resulting in that the fine adjustment of the fixing position of each of the limit switch mechanisms 130, 131 (namely, the fine adjustment of the detection position of the rope guide mechanism 95) can be easily operated.

Further, each of the support shaft 133 and the limit switch bolt 134 is supported by the both-end support structure in which the end portion in the X1 direction is supported by the main body part 13 being one end frame member, and the end portion in the X2 direction is supported by the back frame 14 being the other end frame member. Therefore, the limit switch metal fitting 135 is supported by both of the support shaft 133 and the limit switch bolt 134. Consequently, the postures of the limit switch mechanisms 130, 131 are stabilized, and the contact position and the contact state between the limit switch mechanisms 130, 131, and the rope guide mechanism 95 become substantially constant, resulting in that it becomes possible to suppress scattering of timings of stopping the drum motor 11. Further, since the limit switch mechanisms 130, 131 are arranged inside the main body cover 18, it is possible to prevent damage of the limit switch mechanisms 130, 131 caused when an object from the outside hits against the limit switch mechanisms.

Further, the present embodiment includes the moving member support shaft 96 and the support shaft 133, in which the rotation regulating part 104 of the rope guide mechanism 95 is fitted to the moving member support shaft 96 to regulate the rotation of the rope guide mechanism 95, and the limit switch metal fitting 135 is attached to the support shaft 133. Both of the support shafts 96, 133 are parallel to the rope drum 10, and the mutual positional accuracy between the rope guide mechanism 95 and the limit switch mechanisms 130, 131, is increased, so that it is possible to accurately detect the winding amount of the wire rope W.

Further, the support shaft 133 and the limit switch bolt 134 collaborate to support the limit switch mechanisms 130, 131. Therefore, even if the limit switch bolt 134 is set to have the cantilever support structure in which it is supported only by one of the end frame members, by supporting (fixing) the limit switch mechanisms 130, 131 between the limit switch bolt 134 and the support shaft 133, the limit switch bolt 134 substantially has the both-end support structure, and thus it is possible to reliably support and fix the limit switch mechanisms 130, 131.

Further, the limit switch mechanism 130 is attached so that the tip portion 149*a* of the detector 132 is directed toward the direction in which the wire rope W is wound-up (the X1 direction), and the limit switch mechanism 131 is attached so that the tip portion 149*a* of the detector 132 is directed toward the direction in which the wire rope W is unwound (the X2 direction). By designing as above, it is only required to switch only the attachment direction of the limit switch main body part 136 to which the detector 132 is attached, with respect to the limit switch metal fitting 135, without changing the components of the limit switch mechanism 130 and the limit switch mechanism 131, which is also effective in terms of cost.

Note that the present invention is not limited to the above-described embodiment, and the present invention includes modification, improvement, and the like within a range capable of achieving the object of the present invention. For example, in the above-described embodiment, each of the limit switch mechanisms 130, 131 is structured to use the limit switch using the detector 132, and as the limit switch, it is possible to use a roller plunger type limit switch, a roller lever type limit switch, or a hinge lever type limit switch.

Further, in the above-described embodiment, the limit switch mechanisms 130, 131 are supported by the support shaft 133 and the limit switch bolt 134, but, they may also be structured to be supported only by the limit switch bolt 134. Further, it is also possible to design such that only one of the limit switch mechanisms 130, 131 employs the structure described in the aforementioned embodiment, and the other is combined with a conventional structure, or supported only by the limit switch bolt 134.

Further, although it is designed such that the rope guide mechanism 95 presses and moves the detector 132 of each of the limit switch mechanisms 130, 131, it is also possible to configure such that a member which moves in conjunction with the rope guide mechanism 95 is provided, and the detector 132 is pressed and moved by this member. Further, it is also possible that one or both of the limit switch mechanisms 130, 131 have a structure in which the support shaft 133 is not used, or a structure in which the limit switch bolt 134 is not used. Further, although the limit switch mechanisms 130, 131 are arranged inside the main body cover 18, it is also possible that such a configuration is not employed, and the limit switch mechanisms are designed to be exposed to the outside.

Further, the rope hoist 1 in the above-described embodiment is one of so-called 4/1 reeving type in which one end of the wire rope W is fixed to the rope drum 10, the other end of the wire rope W is fixed to the rope pressing metal fitting 81, and the intermediate sheave 31 is arranged between the rope drum 10 and the rope pressing metal fitting 81. However, the present invention is not applied only to the 4/1 reeving type. For example, the present invention can also be applied to a so-called 2/1 reeving type in which one end of the wire rope W is fixed to the rope drum 10 and the other end of the wire rope W is fixed to the rope pressing metal fitting 81, but, the intermediate sheave is not used. Further, the present invention can also be applied to a so-called 4/2 reeving type in which one end of the wire rope W is fixed to one rope drum 10, the other end of the wire rope W is fixed to another rope drum (a direction of rope grooves of this rope drum is reverse to that of the rope drum 10), and an intermediate sheave is arranged between the rope drums. Further, the present invention can also be applied to rope hoists of the other types.

Further, although the above-described embodiment is described by citing the rope hoist 1 as an example, the present invention can also be applied to another apparatus which performs hoisting of a rope such as a wire rope. Further, when a rope hoist is used, it is possible to employ one having no support shaft. Further, it is possible that a simple shaft is employed instead of the limit switch bolt 134, and a fitting member such as a C ring fitted to the shaft is used instead of the nut. As described above, the combination between the limit switch bolt 134 and the nut 150 can also be changed to another combination. Further, it is also possible that the structure in which the limit switch metal fitting 135 is sandwiched, from both sides thereof, by the nuts 150, is not employed, and the limit switch metal fitting 135 may be sandwiched by a C ring from one side thereof and a nut from the other side thereof.

REFERENCE SIGNS LIST

1 . . . Rope hoist
2 . . . Rope drum mechanism
3 . . . Trolley mechanism
4 . . . Control unit
5 . . . Hook part
10 . . . Rope drum
11 . . . Drum motor
13 . . . Main body part (end frame member)
14 . . . Back frame (end frame member)
95 . . . Rope guide mechanism (moving member)
130 . . . Limit switch mechanism (X1 side)
131 . . . Limit switch mechanism (X2 side)
132 . . . Detector
133 . . . Support shaft
134 . . . Limit switch bolt (limit switch fixing bar)
135 . . . Limit switch metal fitting
137 . . . Main body part (limit switch metal fitting)
139 . . . Through hole (limit switch metal fitting)
140 . . . Through hole (limit switch metal fitting)
149*a* . . . Tip portion of detector
150 . . . Nut (fixing means)

The invention claimed is:

1. A rope hoist, comprising:

a rope drum around which a wire rope can be wound;

end frame members respectively arranged at both ends of the rope drum, the rope drum being rotatably supported by the end frame members;

a support shaft bridged between both of the end frame members, and arranged to be parallel to the rope drum;

limit switch mechanisms arranged at a predetermined wind-up position and a predetermined unwind position, respectively, of the wire rope, the limit switch mechanisms each having a limit switch metal fitting; and a moving member moving in accordance with a winding state of the wire rope, and making the limit switch mechanisms perform on/off operation;

the rope hoist comprising:

a limit switch fixing bar arranged to be parallel to the support shaft and the rope drum;

wherein both of the support shaft and the limit switch fixing bar are inserted into each of the limit switch metal fittings; and the limit switch metal fitting is fixed by a fixing means in a manner that a position of the limit switch metal fitting in an axial direction of the limit switch fixing bar can be adjusted.

2. The rope hoist according to claim 1, wherein the limit switch fixing bar corresponds to a limit switch bolt, and the fixing means corresponds to nuts screwed with the limit switch bolt; and the limit switch metal fitting is sandwiched and fixed by the nuts from both sides thereof in an axial direction of the limit switch bolt.

3. The rope hoist according to claim 1, wherein a moving member support shaft which is bridged between both of the end frame members and arranged to be parallel to the rope drum regulates a rotation of the moving member.

4. The rope hoist according to claim 1, wherein two of the limit switch mechanisms are arranged, and each of the limit switch mechanisms includes a limit switch main body part provided with a switch mechanism, and a detector; the limit switch mechanism arranged at the wind-up position of the wire rope is attached so that a tip portion of the detector is directed to a direction in which the wire rope is wound-up; and the limit switch mechanism arranged at the unwind position of the wire rope is attached so that a tip portion of the detector is directed to a direction in which the wire rope is unwound.

5. The rope hoist according to claim 2, wherein a moving member support shaft which is bridged between both of the end frame members and arranged to be parallel to the rope drum regulates a rotation of the moving member.

6. The rope hoist according to claim 2, wherein two of the limit switch mechanisms are arranged, and each of the limit switch mechanisms includes a limit switch main body part provided with a switch mechanism, and a detector; the limit switch mechanism arranged at the wind-up position of the wire rope is attached so that a tip portion of the detector is directed to a direction in which the wire rope is wound-up; and the limit switch mechanism arranged at the unwind position of the wire rope is attached so that a tip portion of the detector is directed to a direction in which the wire rope is unwound.

7. The rope hoist according to claim 3, wherein two of the limit switch mechanisms are arranged, and each of the limit switch mechanisms includes a limit switch main body part provided with a switch mechanism, and a detector; the limit switch mechanism arranged at the wind-up position of the wire rope is attached so that a tip portion of the detector is directed to a direction in which the wire rope is wound-up; and the limit switch mechanism arranged at the unwind position of the wire rope is attached so that a tip portion of the detector is directed to a direction in which the wire rope is unwound.

8. The rope hoist according to claim 1, wherein two of the limit switch mechanisms are arranged, and each of the limit switch mechanisms includes a limit switch main body part provided with a switch mechanism, and a detector; the limit switch mechanism arranged at the wind-up position of the wire rope is attached so that a tip portion of the detector is directed to a direction in which the wire rope is wound-up; and the limit switch mechanism arranged at the unwind position of the wire rope is attached so that a tip portion of the detector is directed to a direction in which the wire rope is unwound.

* * * * *